US006212351B1

(12) United States Patent
Kawagoe et al.

(10) Patent No.: US 6,212,351 B1
(45) Date of Patent: Apr. 3, 2001

(54) IMAGE TRANSFERRING METHOD AND IMAGE FORMING APPARATUS FOR TRANSFERRING TONER IMAGE FROM IMAGE CARRIER TO RECORDING MEDIUM EITHER VIA OR CARRIED ON INTERMEDIATE IMAGE TRANSFER BELT

(75) Inventors: Katsuya Kawagoe, Kanagawa; Shin Kayahara; Yasunori Kawaishi, both of Chiba, all of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/447,566

(22) Filed: Nov. 23, 1999

(30) Foreign Application Priority Data

Nov. 24, 1998 (JP) ..... 10-333099

(51) Int. Cl.[7] ..... G03G 15/01
(52) U.S. Cl. ..... 399/302; 399/303
(58) Field of Search ..... 399/66, 302, 303, 399/308, 312, 313

(56) References Cited

U.S. PATENT DOCUMENTS

| | | | | |
|---|---|---|---|---|
| 5,159,392 | | 10/1992 | Kasahara et al. . | |
| 5,172,173 | * | 12/1992 | Goto et al. | 399/312 |
| 5,278,613 | | 1/1994 | Bisaiji et al. . | |
| 5,335,052 | * | 8/1994 | Sato et al. | 399/312 |
| 5,574,550 | * | 11/1996 | Okazaki et al. | 399/313 |
| 5,655,199 | * | 8/1997 | Yamashita et al. | 399/302 |
| 5,697,032 | * | 12/1997 | Kimura et al. | 399/302 |
| 5,890,030 | | 3/1999 | Namekata et al. . | |
| 5,905,013 | * | 5/1999 | Seto | 430/126 |
| 5,970,296 | * | 10/1999 | Takase | 399/310 |
| 6,006,062 | * | 12/1999 | Takahashi et al. | 399/310 |
| 6,061,543 | * | 5/2000 | Kayahara et al. | 399/302 |

FOREIGN PATENT DOCUMENTS

| | | | |
|---|---|---|---|
| 5-249842 | * | 9/1993 | (JP) . |
| 5-297723 | * | 11/1993 | (JP) . |
| 8-166731 | | 6/1996 | (JP) . |
| 8-240959 | | 9/1996 | (JP) . |
| 10-161440 | | 6/1998 | (JP) . |

* cited by examiner

*Primary Examiner*—Robert Beatty
(74) *Attorney, Agent, or Firm*—Oblon, Spivak, McClelland, Maier & Neustadt, P.C.

(57) ABSTRACT

An image forming apparatus and method of using the apparatus including: an image carrier; and an intermediate image transfer unit. The intermediate transfer unit includes: an intermediate image transfer belt which is movable while contacting a surface of the image carrier over a preselected distance; a discharging member for discharging a charge deposited on the intermediate image transfer belt at a nip between the intermediate image transfer belt and the image carrier; a charge depositing member for depositing a transfer charge on the intermediate image transfer belt at a position downstream of the nip in a direction of movement of the intermediate image transfer belt, whereby a toner image formed on the image carrier is transferred to the intermediate image transfer belt itself or a recording medium by an electric field formed at the nip; and the discharging member discharging the charge deposited on the intermediate image transfer belt at the nip so that the discharging member is in contact with a surface of the intermediate image transfer belt opposite to a surface contacting the image carrier with a pressure between 0.05 N/cm$^2$ and 2 N/cm$^2$.

53 Claims, 6 Drawing Sheets

| | SECONDARY TRANSFER CURRENT (μA) |
|---|---|
| PLAIN PAPER (1C MODE) | 25 |
| PLAIN PAPER (4C MODE) | 35 |
| THICK PAPER (1C MODE) | 14 |
| THICK PAPER (4C MODE) | 18 |
| ULTRA THICK PAPER (1C MODE) | 16 |
| ULTRA THICK PAPER (4C MODE) | 20 |

| | SECONDARY TRANSFER CURRENT (μA) |
|---|---|
| PLAIN PAPER (1C MODE) | 10 |
| PLAIN PAPER (4C MODE) | 18 |
| THICK PAPER (1C MODE) | 8 |
| THICK PAPER (4C MODE) | 10 |
| ULTRA THICK PAPER (1C MODE) | ZERO |
| ULTRA THICK PAPER (4C MODE) | ZERO |

IMAGE TRANSFERRING METHOD AND IMAGE FORMING APPARATUS FOR TRANSFERRING TONER IMAGE FROM IMAGE CARRIER TO RECORDING MEDIUM EITHER VIA OR CARRIED ON INTERMEDIATE IMAGE TRANSFER BELT

BACKGROUND OF THE INVENTION

The present invention relates to an image forming method of the type transferring a toner image from an image carrier to a recording medium via an intermediate image transfer belt, or intermediate image transfer body, or transferring it from the image carrier to a recording medium carried on a transfer belt, or medium carrier, and a copier, printer facsimile apparatus or similar image forming apparatus for practicing the same.

An image forming apparatus of the type transferring a toner image from a photoconductive element or image carrier to an intermediate image transfer belt (primary transfer) is well known in the art. For the primary transfer, use may be made of an indirect bias application system, which applies a bias for image transfer indirectly to the belt. In the indirect bias application system, a bias roller for belt transfer is positioned downstream of a nip between the photoconductive element and the belt while a ground roller is positioned upstream of the nip. The above bias is applied to the bias roller in order to transfer a toner image from the photoconductive element to the belt.

The problem with the above image forming apparatus is that toner is scattered at the time of primary transfer of a toner image from the photoconductive element to the belt. Specifically, at the time of primary transfer, a toner image formed on the photoconductive element is not transferred to a preselected position on the belt, but is scattered around the preselected position and blurred. Particularly, such scattering of toner causes thin lines to lose sharpness.

One cause of the scattering of toner is so-called pretransfer, i.e., the transfer of toner from the photoconductive element to the belt occurring at a position upstream of the nip between the element and the belt in the direction of movement of the element, as well known in the art. Another cause is so-called retransfer, i.e., the transfer of toner from the belt back to the photoconductive element occurring at a position downstream of the above nip. More specifically, as for pretransfer, when the bias is applied to the bias roller, a potential slope occurs between the bias roller and the ground roller and forms an electric field even at the side upstream of the nip, causing the toner to move toward the belt away from the photoconductive element. As for retransfer, the toner image successfully transferred from the photoconductive element to the belt is disturbed by an electric field for image transfer formed at the side downstream of the nip.

Presumably, the above pretransfer and retransfer also occur when a toner image is directly transferred from the photoconductive element to an image transfer belt used to convey a recording medium.

It is a common practice with an image forming apparatus using the intermediate image transfer belt or the transfer belt to cause the belt to contact an object facing it by use of a pressing member. The pressing member presses the surface of the belt opposite to the surface expected to contact the object. However, with this kind of arrangement, it is likely that when the belt is left unused over a long time, both the belt and the object contacting each other over a long time are damaged, and the belt curls complementarily to the contour of the pressing member. The cur led portion of the belt would vary the mechanical contact condition and therefore the image transfer condition on entering the nip and would thereby bring about a defective image ascribable to, e.g., irregular image transfer.

The above problem arises not only in an image forming apparatus including the image transfer belt or the transfer belt, or image transfer body, to which a toner image is transferred from the image carrier, but also in an image forming apparatus including a belt, a pressing member for pressing the belt, and an object which the surface of the belt opposite to the surface pressed by the pressing member contacts.

Technologies relating to the present invention are disclosed in, e.g., Japanese Patent Laid-Open Publication Nos. 5-249842, 8-166731, 8-2409591, and 10-161440.

SUMMARY OF THE INVENTION

It is therefore an object of the present invention to provide an image transferring method capable of obviating pretransfer and retransfer apt to occur during belt transfer, and an image forming apparatus for practicing the same.

It is another object of the present invention to provide an image forming apparatus capable of preventing a belt from curling.

It is another object of the present invention to provide an image forming apparatus capable of preventing a belt from curling and freeing the belt and an object which the belt is expected to contact from damage ascribable to a long time of contact.

In accordance with the present invention, in an image transferring method for discharging, at a nip between an image carrier and an intermediate image transfer belt moving while contacting the surface of the image carrier over a preselected distance, a charge deposited on the belt, depositing a transfer charge on the belt at a position downstream of the nip in the direction of movement of the belt, and transferring a toner image formed on the image carrier to the belt by an electric field formed at the nip, a discharging member for discharging the belt discharges, at the nip, the belt in contact with the surface of the belt opposite to the surface contacting the image carrier with a pressure between 0.05 $N/cm^2$ and 2 $N/cm^2$.

Also, in accordance with the present invention, an image forming apparatus includes an image carrier, and an intermediate image transfer unit. The intermediate image transfer unit includes an intermediate image transfer belt movable while contacting the surface of the image carrier over a preselected distance, a discharging member for discharging a charge deposited on the belt at a nip between the belt and the image carrier, and a charge depositing member for depositing a transfer charge on the belt at a position downstream of the nip in the direction of movement of the belt. A toner image formed on the image carrier is transferred to the belt by an electric field formed at the nip. At the nip, the discharging member discharges the belt in contact with the surface of the intermediate image transfer belt opposite to the surface contacting the image carrier with a pressure between 0.05 $N/cm^2$ and 2 $N/cm^2$.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
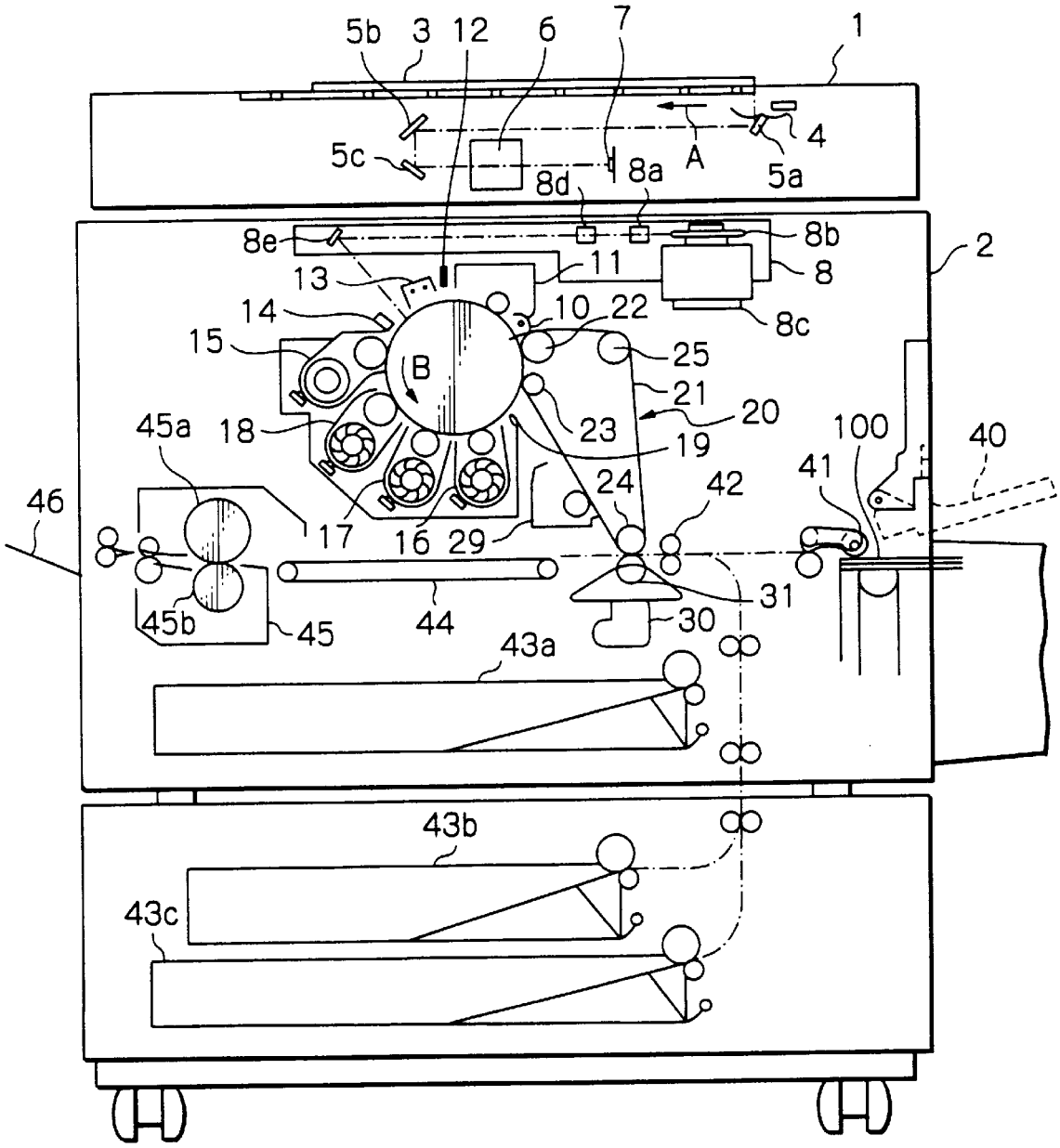
FIG. 1 is a section showing an image forming apparatus embodying the present invention.
Figure 2:
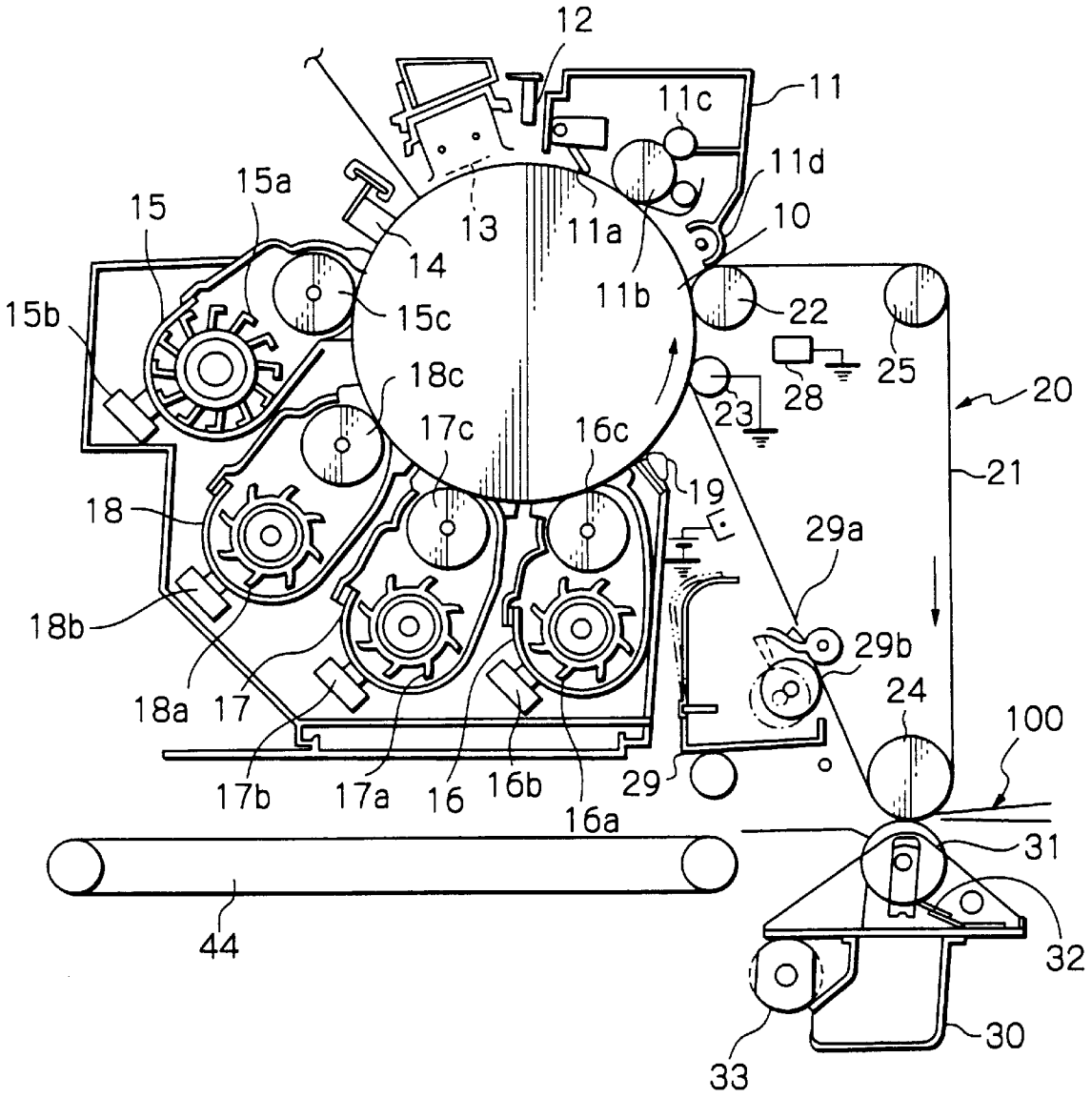
FIG. 2 is a view showing a photoconductive element included in the illustrative embodiment together with various units arranged around the element.

Referring to FIGS. 1 and 2 of the drawings, a preferred embodiment of the present invention is shown which is implemented as a full-color electrophotographic copier by way of example. As shown, the copier is generally mage up of a scanner section or color image reading device 1 and a printer section or color image recording device 2.

The scanner section 1 includes a lamp 4 for illuminating a document 3 laid on a glass platen. The resulting reflection from the document is incident to a color image sensor 7 via mirrors 5*a*, 5*b* and 5*c* and a lens 6. The color image sensor 7 separates color image information incident thereto to, e.g., a blue (B), a green (G) and a red (R) component and transforms the B, G and R components to a B, a G and an R electric signal, respectively. To read the three colors at the same time, the image sensor 7 includes color separating means and CCDs (Charge Coupled Devices) or similar photoelectric transducers. An image processing section, not shown, executes color conversion with the B, G and R image signals on the basis of intensity level to thereby output black (Bk), cyan (C), magenta (M) and yellow (Y) color image data. More specifically, in response to a start signal associated with the operation of the printer section 2, the above scanning optics scans the document in a direction indicated by an arrow A in FIG. 1 so as to output the color image data. In the illustrative embodiment, every time the optics sans the document, image data of one color is output. Therefore, to output the Bk, C, M and Y color image data, the optics scans the same document four consecutive times.

The printer section 2 includes an optical writing unit or exposing means 8 and a photoconductive drum 10 which is a specific form of an image carrier. The optical writing unit 8 converts the color image data output from the scanner section 1 to optical signals so as to sequentially form electrostatic latent images on the drum 10. The optical writing unit 8 may be implemented by a semiconductor laser 8*a*, a controller for controllably driving the laser 8*a*, a polygonal mirror 8*b*, a motor 8*c* for driving the mirror 8*b*, an f/θ lens 8*d*, and a mirror 8*e*. The drum 10 is rotated in a direction indicated by an arrow B in FIG. 1, i.e., counterclockwise.

Arranged around the drum 10 are a drum cleaning unit or drum cleaning means 11, a discharge lamp or discharging means 12, a charger or charging means 13, a potential sensor or potential sensing means 14, a Bk developing unit 15, a C developing unit 16, an M developing unit 17, a Y developing unit 18, a density pattern sensor or density sensing means 19, and an intermediate image transfer unit 20. The cleaning unit 11 includes a blade 11*a*, a brush roller or applying means 11*b* for applying a lubricant to the drum 10, and a precleaning discharger 11*d*. The Bk, C, M and Y developing units 15–18 constitute developing means.

The blade 11*a* is constantly held in contact with the drum 10 for removing toner left on the drum 10 after primary transfer. The brush roller 11*b* also constantly held in contact with the drum 10 applies a lubricant to the surface of the drum 10 in order to enhance the cleaning ability of the cleaning unit 11. Specifically, when a drive mechanism, not shown, connected to the shaft of the brush roller 11*b* causes the roller 11*b* to rotate, the roller 11*b* shaves off solid zinc stearate 11*c* and applies the resulting fine powder of zinc stearate to the drum 10.

The developing units 15–18 respectively include paddles 15*a*–18*a*, toner content sensors 15*b*–18*b*, and developing sleeves 15*c*–18*c*. The paddles 15*a*–18*a* each play the role of agitating means for agitating a developer while scooping it up. The toner content sensors 15*b*–18*b* each are toner content sensing means responsive to the toner content of a developer. The developing sleeves 15*c*–18*c* each are a developer carrier for causing the ear of a developer formed thereon to contact the surface of the drum 10. While the copier is in a stand-by state, the developing units 15–18 each maintain the ear of the developer deposited on the respective developing sleeve in an inoperative position.

The intermediate image transfer unit 20 includes an intermediate image transfer belt or intermediate image transfer body 21 passed over a primary transfer bias roller or charge depositing means 22, a ground roller or primary pretransfer discharging means 23, a drive roller or drive means 24, and a driven roller 25. The primary transfer bias roller 22 is connected to a primary transfer power supply 28. A motor, not shown, is drivably connected to the intermediate image transfer belt 21.

The above belt 21 has a laminate structure made up of a surface layer, an intermediate layer, and a base layer although not shown specifically. The belt 21 is positioned such that the surface layer contacts the drum 10 while the base layer is remotest from the drum 10. An adhesive layer, not shown, intervenes between the intermediate layer and the base layer. The belt 21 has a volume resistivity of $10^{11}$ Ωcm to $10^{14}$ Ωcm, preferably $10^{12}$ Ωcm to $10^{13}$ Ωcm or more preferably $10^{13}$ Ωcm, as measured by a method prescribed by JIS (Japanese Industrial Standards) K6911.

In the illustrative embodiment, the surface layer and intermediate layer of the belt 21 each have a high resistance while the base layer has a medium volume resistivity of $10^{8}$ Ωcm to $10^{11}$ Ωcm. This configuration is, of course, only illustrative.

A belt cleaning unit 29 adjoins the belt 21 and includes, like the drum cleaning unit 11, a blade 29*a* and a brush roller 29*b* for applying a lubricant implemented by solid zinc stearate to the belt 21. The blade 29*a* contacts the belt 21 in an orientation counter to the direction in which the belt 21 moves, as illustrated. The brush roller 29*b* faces the surface of the belt 21 at a position upstream of the position where the blade 29*a* contacts the belt 21 in the direction of movement of the belt 21. A gear, not shown, is mounted on the shaft of the brush roller 29*b* and rotated to, in turn, rotate the roller 29*b*. As a result, the brush roller 29*b* shaves off the solid zinc stearate and applies the resulting fine powder to the belt 21. Moving means, not shown, selectively brings the blade 29*a* and brush roller 29*b* into or out of contact with the belt 21.

An image transfer unit or image transferring means 30 also adjoins the belt 21 and includes a secondary transfer bias roller 31 facing the drive roller 24, a cleaning blade 32, and a moving mechanism 33 for selectively moving the unit 30 into or out of contact with the belt 21.

The printer section 2 further includes a pick-up roller 41 for feeding, via a registration roller pair 42, a paper or similar recording medium 100 toward a secondary image transfer region between the secondary transfer bias roller 31 and the portion of the belt 21 contacting the drive roller 24. Paper cassettes 43*a*, 43*b* and 43*c* each are loaded with papers 100 of particular size. A manual feed tray 40 is available for feeding OHP (OverHead Projector) sheets, thick sheets and other special sheets by hand. The printer section 2 additionally includes a conveyor unit 44, a fixing unit or fixing means 45 including a heat roller 45*a* and a press roller 45*b*, and a copy tray 46.

The operation of the illustrative embodiment will be described on the assumption that it sequentially forms a Bk, a C, an M and a Y toner image in this order by way of example. On the start of the copying operation, the scanner section 1 reads a document laid on the glass platen. The optical writing unit 8 scans the surface of the drum 10 with a laser beam based on the resulting Bk image data, thereby forming a Bk latent image on the drum 10. The Bk developing unit 15 develops the Bk latent image with Bk toner to thereby form a Bk toner image. To insure the development of the Bk latent image, the developing sleeve 15*a* of the Bk developing unit 15 is caused to start rotating before the leading edge of the Bk latent image arrives at a developing position assigned to the developing unit 15. That is, the developer deposited on the developing sleeve 15 is held in an operative position before the leading edge of the Bk latent image arrives at the above developing position. As soon as the trailing edge of the Bk latent image moves away from the developing position, the developer on the sleeve 15*a* is immediately brought to the inoperative position, rendering the developing unit 15 inoperative. This is completed at least before the leading edge of a C latent image to be developed next arrives at the developing position of the Bk developing unit 15. To render the developer on the sleeve 15*a* inoperative, the sleeve 15*a* may be rotated in the direction opposite to the direction for development.

The Bk toner image formed on the drum 10 is transferred from the drum 10 to the surface of the belt 21 moving at the same speed as the drum 10 (primary transfer).

In parallel with the primary transfer of the Bk toner image, the scanner section 1 again reads the same document at a preselected timing in order to produce C image data. The optical writing unit 8 scans the drum 10 in accordance with the C image data to thereby form a C latent image on the drum 10. The C developing unit 16 develops the C latent image so as to form a C toner image. The developing sleeve 16*a* of the C developing unit 16 is caused to start rotating after the trailing edge of the Bk latent image has moved away from a developing position assigned to the developing unit 16, but before the leading edge of the C latent image arrives at the developing position. As soon as the trailing edge of the C latent image moves away from the developing position, the developer on the sleeve 16*a* is immediately brought to the inoperative position, rendering the developing unit 16 inoperative. This is completed at least before the leading edge of an M latent image to be developed next arrives at the developing position of the C developing unit 16. The C toner image is transferred from the drum 10 to the belt 21 over the Bk toner image existing on the belt 21 (primary transfer).

The above procedure is repeated with an M latent image and a Y latent image also. As a result, the Bk and C toner images and an M and a Y toner image are sequentially transferred from the drum 10 to the belt 21 one above the other in this order, forming a full-color toner image on the belt 21.

During the interval between the primary transfer of one toner image and that of the next toner image, e.g., the primary transfer of the first or Bk toner image and that of the second or C toner image, the belt 21 is driven by any one of conventional systems including a constant speed forward system, a skip forward system, and a reciprocation or quick return system. If desired, to increase the copy speed, any one of the above drive systems may be selected in accordance with the copy size, or a plurality of them may be efficiently combined.

Briefly, the constant forward system is such that the belt 21 is driven forward at a low speed during primary transfer. The skip forward system is such that after the forward movement effected for the primary transfer in the same manner as in the constant forward system, the belt 21 is released from the drum 10 and then caused to skip forward to a primary transfer start position at a high speed. The reciprocation or quick return system is such that after the belt 21 has been released from the drum 10 in the same manner as in the skip forward system, it is returned in the reverse direction to a primary transfer start position at a high speed.

The belt 21 carrying the full-color image thereon conveys the image to the secondary image transfer region in order to transfer it to the paper 100 (secondary transfer). Usually, the moving mechanism 33 presses the secondary transfer bias roller 31 against the belt 21 at a timing for transferring the toner image to the paper 100. Subsequently, a preselected bias for secondary transfer is applied to the bias roller 31 in order to form an electric field in the secondary image transfer region. As a result, the toner image is transferred from the belt 21 to the paper 100. Specifically, the paper 100 is fed from one of the paper cassettes 43*a*–43*c* designated by the operator via an operation panel, not shown, to the secondary image transfer region via the registration roller pair 42. The registration roller pair 42 drives the paper 100 toward the secondary image transfer region such that the leading edge of the paper 100 meets the leading edge of the toner image formed on the belt 21.

The conveyor unit 44 conveys the paper 100 carrying the full-color toner image thereon to the fixing unit 45. The fixing unit 45 fixes the toner image on the paper 100 with the heat roller 45*a* and press roller 45*b*. The paper or copy 100 is then driven out to the copy tray 46.

After the primary transfer, the drum cleaning blade 11*a* removes the toner left on the drum 10, and then the brush roller 11*b* applies zinc stearate to the cleaned surface of the drum 10.

In a repeat copy mode, the scanner section 1 having output the Y or fourth color image data for the first copy starts the Bk or first color step for the second copy at a preselected timing. The printer section 2 forms a Bk latent image for the second copy on the drum 10. After the secondary transfer of the first full-color toner image from the belt 21 to the first paper 100, a Bk toner image for the second copy is transferred from the drum 10 to the portion of the belt 21 having been cleaned by the cleaning blade 29*a*.

In a three-color or a two-color copy mode, the illustrative embodiment operates in the same manner as in the above full-color or four-color mode except for the colors of toner.

In a one-color copy mode, the developer stored in designated one of the developing units 15–18 is constantly held operative until a desired number of copies have been produced. In this case, the belt cleaning blade 29*a* and image transfer unit 30 are held in contact with the belt 21 while the belt 21 is held in contact with the drum 10. In this condition, the belt 21 is driven forward at a preselected speed.

Part of the above construction and operation unique to the illustrative embodiment will be described more specifically hereinafter. As shown in FIG. 2, the primary transfer bias roller 22 is positioned downstream of a nip between the drum 10 and the belt 21, i.e., a primary image transfer region. The power supply 28 applies a preselected bias for primary transfer to the bias roller 22. The ground roller or discharging means 23 connected to ground is pressed against the inner surface of the belt 21 by a preselected pressure, so that the belt 21 is pressed against the drum 10. The ground roller 23 therefore forms the start point of the nip between the drum 10 and the belt 21.

It is noteworthy that the primary transfer bias roller 22 and ground roller 23 supporting the belt 21 replace a separate charge depositing member and a separate discharging member otherwise located at the above nip, thereby saving cost and space.

Further, in the illustrative embodiment, by simply connecting the ground roller 23 to ground, it is possible to discharge the charge deposited on the belt 21 by the primary transfer bias roller 22. Consequently, the charge deposited on the belt 21 substantially does not migrate or migrates little to the side upstream of the start point of the nip between the belt 21 and the drum 10. That is, the charge does not exist or exists little on the belt 21 upstream of the above nip. It follows that an electric field effecting the toner image transferred to the belt 21 does not exit at the side upstream of the nip. This, coupled with the fact that the belt 21 and drum 10 pressed against each other by the ground roller 23 press the toner entered the nip, causes the toner to cohere on the belt 21.

As stated above, despite the bias applied to the bias roller 22 located downstream of the nip in the direction of movement of the belt 21, no electric fields causative of pretransfer are formed at the upstream side. In addition, because the toner coheres at the nip, the toner image is disturbed little and prevented from being retransferred to the drum 10 even when subjected to an electric field at the downstream side. The ground roller 23 should preferably be pressed against the belt 21 by a pressure of 0.05 $N/cm^2$ or above. Should the pressure be excessively low, the effect achievable with the cohesion of the toner would be lost.

On the other hand, should the pressure pressing the ground roller 23 against the belt 21 be excessively high, both the adhesion of the toner to the drum 10 and the adhesion of the same to the belt 21 would increase. If the adhesion of the toner to the drum 10 increases, it is likely that the toner remains on the drum 10 and results in a vermicular image. In light of this, the above pressure should preferably be 2 $N/cm^2$ or below.

To increase the adhesion of the toner to the belt 21, the drum 10 and belt 21 each may be formed of a particular material, or the amount of zinc stearate to be applied to the drum 10 and belt 21 may be adjusted. This, however, cannot fully obviate vermicular images because the adhesion is sometimes partly inverted.

A separate discharging member may be located at the above nip and implemented by any one of a brush, a blade and a roller. In such a case, a roller is preferable in consideration of damage to the belt 21 and the movement of the discharging member caused by the movement of the belt 21. Further, because the separate discharging member would reduce the substantial image transfer region upstream of the discharge position, compared to the ground roller 23 forming the start point of the nip. The separate discharge member should therefore be positioned as close to the start point of the nip as possible. This is successful to form a relatively broad substantial image transfer region and therefore to increase the image transfer efficiency.

As stated above, the illustrative embodiment obviates pretransfer and retransfer of a toner image and thereby insures attractive images free from toner scattering.

Figure 3:
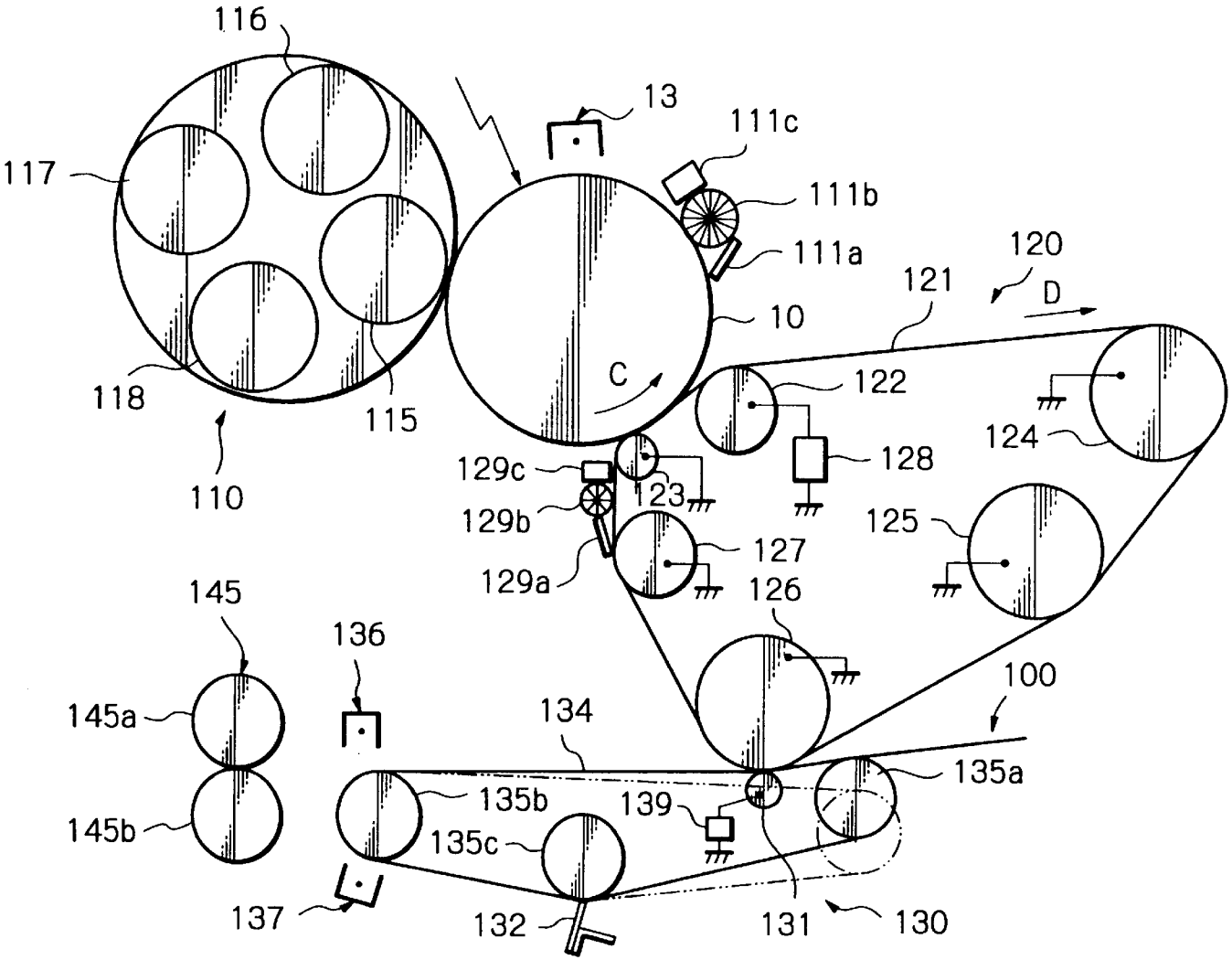
FIG. 3 is a view showing an alternative embodiment of the present invention.

Reference will be made to FIG. 3 for describing an alternative embodiment of the present invention also implemented as a full-color electrophotographic copier. This embodiment also includes the scanner section, not shown, and basically operates in the same manner as the previous embodiment. This embodiment differs from the previous embodiment mainly in the construction and operation of the printer section. As shown, the printer section includes the drum 10. Arranged around the drum 10 are the optical writing unit, not shown, a drum cleaning unit or drum cleaning means 111, the charger 13, a revolver type developing unit (revolver hereinafter) 110, and an intermediate image transfer unit or intermediate image transferring means 120. The drum cleaning unit 111 includes a cleaning blade 111*a* and a brush roller 111*b* for applying a lubricant or solid zinc stearate 111*c* to the drum 10. The printer section additionally includes an image transfer unit or image transferring means 130 and a fixing unit or fixing means 145 including a heat roller 145*a* and a press roller 145*b* as well as the paper feed section and controller described in relation to the previous embodiment.

The drum cleaning blade 111*a* is constantly held in contact with the drum 10 for cleaning the surface of the drum 10 after the primary transfer. The brush roller 111*b* is also held in contact with the drum 10 for applying the lubricant 111*c* to the drum 10 in order to enhance the cleaning ability. Specifically, when the brush roller 111*b* is caused to rotate by a drive mechanism, not shown, connected to the shaft of the roller 111*b*, the roller 111*b* shaves off the lubricant 111*c* and applies the resulting fine lubricant powder to the surface of the drum 10.

The revolver 110 includes a Bk developing section 115, a C developing section 116, an M developing section 117, and a Y developing section 118. The revolver 110 is rotatable to bring any one of the developing sections 115–118 to a developing position where the developing unit faces the drum 10.

The intermediate image transfer unit 120 includes an intermediate image transfer belt or intermediate image transfer body 121 passed over a primary transfer bias roller 122, a ground roller or primary transfer predischarging means 123, a drive roller or belt driving means 124, a tension roller 125, a secondary transfer counter roller 126, and a cleaning counter roller 127. A primary transfer power source 128 is connected to the primary transfer bias roller 122. All the rollers over which the belt 121 is passed are electrically conductive, and all the rollers other than the bias roller 122 are connected to ground. The power source 128 applies a preselected bias subjected to constant current or constant voltage control to the bias roller 122. The belt 121 is identical with the belt 21 of the previous embodiment except that it has a volume resistivity of $10^{12}$ Ωcm to $10^{14}$ Ωcm, preferably $10^{13}$ Ωcm. The surface layer of the belt 121 has a surface resistance of $10^7$ $\Omega/cm^2$ to $10^{14}$ $\Omega/cm^2$.

A belt cleaning blade 129*a* and a brush roller 129*b* for applying a lubricant or zinc stearate 129*c* to the belt 121 adjoin the belt 121. A moving mechanism, not shown, selectively moves the blade 129*a* and brush roller 129*b* into or out of contact with the belt 121. Another moving mechanism, not shown, moves the image transfer unit 130 into and out of contact with the belt 121.

The image transfer unit 130 includes a belt or recording medium carrier 134 for effecting secondary transfer. A belt cleaning blade 132 cleans the surface of the belt 134. A secondary transfer bias roller 131 faces the secondary transfer counter roller 126 included in the intermediate image transfer unit 120. A secondary transfer power source 139 is connected to the bias roller 131. The belt 134 is passed over a first support roller 135*a* located at a paper inlet end, a second support roller 135*b* adjoining the fixing unit 145, and a third support roller 135*c* facing the belt cleaning blade 132. The image transfer unit 130 additionally includes a paper discharger 136 and a belt discharger 137. The belt 134 is formed of PVDF (polyvinyl idene fluoride) and has a volume resistivity as high as $10^{13}$ Ωcm or above. If desired, the belt 134 may be replaced with a drum or any other suitable member.

The operation of the illustrative embodiment will be described on the assumption that a Bk, a C, an M and a Y toner image are sequentially formed in this order. Before the start of an image forming cycle, the drum 10 is rotated counterclockwise, i.e., in a direction indicated by an arrow C in FIG. 3, and the charger 13 starts corona discharge. For example, the charger 13 uniformly charges the drum 10 to a preselected negative potential. The belt 121 of the intermediate image transfer unit 120 is driven at the same speed as the drum 10 in a direction indicated by an arrow D in FIG. 3, i.e., clockwise.

The scanner section outputs color image data at a preselected timing as in the previous embodiment. The optical writing unit scans the charged surface of the drum 10 with a laser beam in accordance with Bk image data by, e.g., raster exposure. As a result, a Bk latent image is electrostatically formed on the drum 10. The Bk developing section 115 of the revolver 110 develops the Bk latent image with toner charged to negative polarity (reversal development), thereby forming a Bk toner image.

The Bk toner image is transferred from the drum 10 to the belt 121 by an electric field formed in the primary image transfer region. The electric field is formed by a charge deposited on the belt 121 by the primary transfer bias roller 122. For example, the power source 128 for primary transfer applies a bias of 1.5 kV to the bias roller 122 for the Bk or first color toner image, a bias of 1.6 kV to 1.8 kV for the C or second color toner image, a bias of 1.8 kV to 2.0 kV for the M or third color toner image, and a bias of 2.0 kV to 2 kV for the Y or fourth color toner image. The drum cleaning blade 111*a* removes the toner left on the drum 10 after the primary transfer, and then the brush roller 111*b* applies the lubricant 111*c* to the drum 10.

The portion of the belt 121 carrying the Bk toner image is again returned to the primary transfer region as in the previous embodiment. At this time, the belt cleaning blade 129*a* and brush roller 129*b* are released form the belt 121 so as not to disturb the toner image. Also, the first support roller 125*a* and secondary transfer bias roller 131 are so moved as to release the bias roller 131 from the belt 121. At this instant, the application of the bias from the power source 139 to the bias roller 131 is interrupted. This condition is maintained until the secondary transfer of a full-color toner image from the belt 121 to the paper 100.

After the primary transfer of the Bk toner image to the belt 121, the scanner section again reads the same document to output C image data. The optical writing unit forms a C latent image with a laser beam in accordance with C image data as in the previous embodiment. The C developing section 116 of the revolver 110 develops the C latent image to thereby produce a C toner image on the drum 10.

In the illustrative embodiment, after the trailing edge of the Bk latent image has moved away from the developing position, the revolver 110 is immediately rotated. This rotation of the revolver 110 is completed before the leading edge of the C latent image arrives at the developing position where the C developing section 116 is positioned. In this condition, the developing section 116 develops the C latent image with C toner.

The above procedure is repeated with an M latent image and a Y latent image also. As a result, the Bk and C toner images and an M and a Y toner image are sequentially transferred from the drum 10 to the belt 121 one above the other, completing a full-color toner image.

The belt 121 carrying the full-color toner image conveys the toner image to the secondary image transfer region. At this instant, the secondary transfer bias roller 131 is brought into contact with the belt 121. Subsequently, a preselected bias for secondary transfer is applied to the bias roller 131 so as to form an electric field in the secondary transfer region. As a result, the full-color toner image is transferred from the belt 121 to the paper 100. Again, the paper 100 is fed such that the leading edge of the paper 100 meets the leading edge of the toner image at the secondary image transfer region.

The belt 134 of the image transfer unit 130 conveys the paper 100 carrying the full-color toner image to a position where the paper discharger 136 is located. The paper discharger 136 discharges the paper 100 and thereby peels off the paper 100 from the belt 134. The paper 100 peeled off is conveyed toward the fixing unit 145. In the fixing unit 145, the heat roller 145*a* and press roller 145*b* fix the toner image on the paper 100 with heat and pressure. Subsequently, the paper or copy 100 is driven out to a copy tray not shown.

After the secondary transfer, the belt cleaning unit 129*a* is brought into contact with the belt 121 in order to remove the toner left on the belt 121, and then the brush roller 129*b* applies the fine powder of the lubricant 129*c* to the belt 121.

After the separation of the paper 100 from the belt 134, the belt discharger 137 discharges the belt 134, and then the belt cleaning blade 132 cleans the surface of the belt 134.

Part of the construction and operation unique to the illustrative embodiment is as follows. As shown in FIG. 3, the primary transfer bias roller or charge depositing means 122 is positioned downstream of the nip between the drum 10 and the belt 121 in the direction of movement of the belt 121, as in the previous embodiment. Also, the ground roller or discharging means 123 is positioned upstream of the above nip and presses the belt 121 against the drum 10 with a pressure between 0.05 N/cm$^2$ and 2 N/cm$^2$. Therefore, the illustrative embodiment is also successful to obviate pretransfer and retransfer and therefore to insure attractive images free from toner scattering.

As shown in FIG. 3, the belt 121 is constantly pressed against the drum 10 by the ground roller 123. This may bring about a problem that when the belt 121 is not driven over a long time, the drum 10 and belt 121 are apt to suffer from damage, and the belt 121 is apt to curl along the circumference of the ground roller 123. The cur led portion of the belt 121 would vary the mechanical contact condition and therefore image transfer condition on entering the nip, resulting in a defective image ascribable to, e.g., irregular image transfer.

Figure 4A:
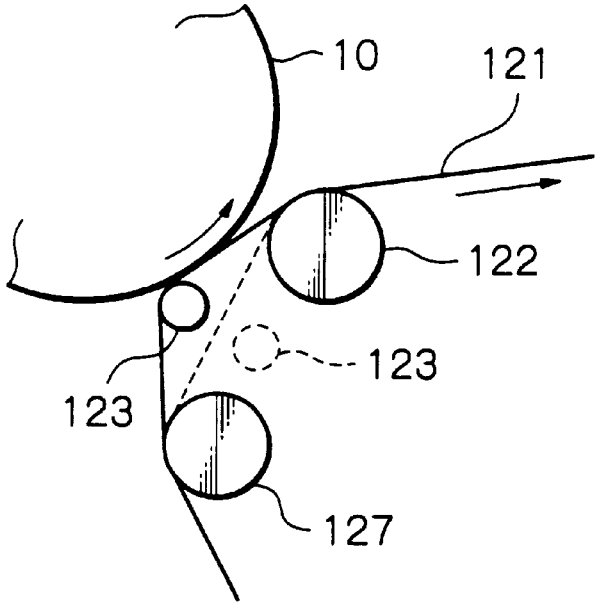
FIGS. 4A and 4B are fragmentary views each showing a specific configuration of moving means included in the embodiment of FIG. 3.
Figure 4B:
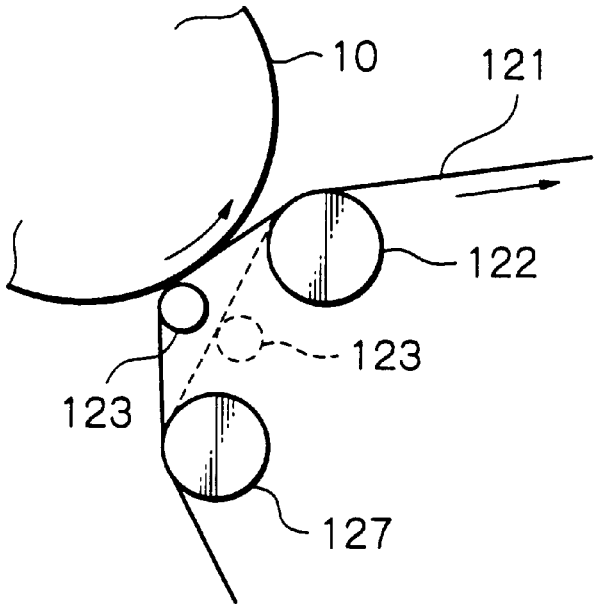

In light of the above, the illustrative embodiment additionally includes moving means for selectively moving the ground roller 123 into or out of contact with the belt 121. The moving means may be implemented by, e.g., a cam device or a solenoid mechanism. Specifically, as shown in FIG. 4A, on the stop of rotation of the belt 121, the moving means moves the ground roller 123 away from the belt 121 in response to a signal received from control means not shown. As a result, the belt 121 is released from the drum 10 and from the ground roller 123. Alternatively, as shown in FIG. 4B, the ground roller 123 may be moved at least to a position where it does not press the belt 121, but contacts the belt 123. With this configuration, it is possible to prevent the belt 121 from being constantly pressed against the drum 10 and therefore to minimize damage to the belt 121 and drum 10. Moreover, the belt 121 is prevented from curling along the circumference of the ground roller 123 even when held inoperative over a long time, thereby solving the above defective image problem.

While a conventional support roller for supporting the belt 121 has a diameter great enough to obviate the curling of the belt 121, the illustrative embodiment including the above moving means is practicable with a roller having a relatively small diameter. In the illustrative embodiment, use is made of a roller having a diameter of 30 mm. Because a mechanism for mounting and dismounting the intermediate image transfer unit 120 is usual ly arranged between the opposite runs of the belt 121 together with other mechanisms, the roller diameter should preferably be as small as possible.

A series of experiments were conducted with the illustrative embodiment under the following conditions. The intermediate transfer belt 121 was 0.15 mm thick and 268 mm wide and had an inner peripheral length of 565 mm. The belt 121 was driven at a speed of 200 mm/sec. Further, the belt 121 had an about 1 $\mu$m thick surface layer formed of an insulating material and an about 75 $\mu$m thick intermediate layer formed of PVDF. The intermediate layer had a volume resistivity of $9\times10^{12}$ Ωcm when a voltage of 100 V was applied for 10 seconds or a volume resistivity of $6\times10^{12}$ Ωcm when a voltage of 500 V was applied for 10 seconds, as measured at a temperature of 25° C. and a humidity of 45% by a resistance measuring device Hirester IP available from Yuka Denshi. In addition, the belt 121 had an about 75 $\mu$m thick base layer formed of PVDF and titanium oxide. The base layer had a volume resistivity of $7\times10^{7}$ Ωcm when a voltage of 100 V was applied for 10 seconds, as measured in the above environment by the same measuring device.

The surface layer of the belt 121 had a surface resistance of $10^{13}$ Ω/cm$^2$ as measured by the above measuring device. To measure the surface resistance, use may be made of a measuring method prescribed by JIS (Japanese Industrial Standards) K6911 in place of the above measuring device.

The primary transfer bias roller 122 was implmented by a metal roller plated with nickel while the ground roller 123 was implemented by a metal roller. The other rollers were formed of metal or conductive resin. The bias roller 122 was applied with a DC voltage of 1.5 kV for the Bk or first color toner image, a DC voltage of 1.7 kV for the C or second color toner image, a DC voltage of 1.9 kV for the M or third color toner image, and a DC voltage of 2.1 kV for the Y or fourth color toner image. The primary image transfer region had a nip width of 10 mm.

Figures 5, 6:
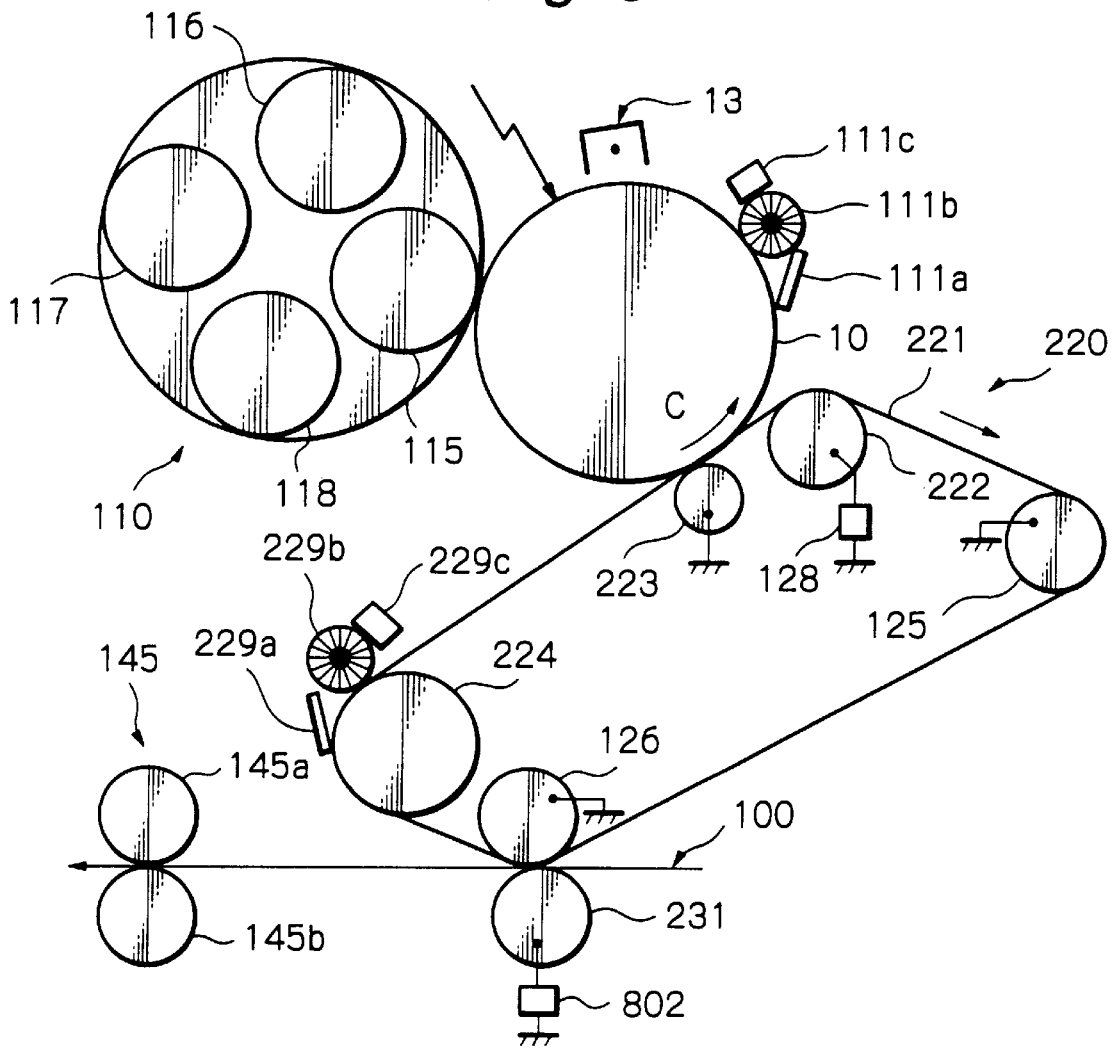
FIG. 5 is a table listing biases to be selectively applied to a secondary transfer bias roller included in the embodiment of FIG. 3.
FIG. 6 is a view showing another alternative embodiment of the present invention.

In the image transfer unit 130, the secondary transfer bias roller 131 had a surface layer formed of conductive sponge or conductive rubber and a core layer formed of metal or conductive resin. A particular transfer bias subjected to constant current control was applied to the bias roller 131 for each of different kinds of papers, as shown in FIG. 5. The secondary image transfer belt 134 was formed of PVDF and had a volume resistivity of $10^{13}$ Ωcm and a thickness of 100 $\mu$m.

The paper discharger 136 and belt discharger 137 each were applied only with an AC voltage or an AC+DC voltage from a power supply not shown. The cleaning blade 132 contacted the portion of the secondary transfer belt 134 contacting the third support roller 135*c* in a counter orientation.

In FIG. 3, the primary transfer bias roller 122 was located downstream of the nip between the drum 10 and the intermediate transfer belt 121 in the direction of movement of the belt 121. The ground roller 123 connected to ground was pressed against the belt 121 by a pressure between 0.05 N/cm$^2$ and 2 N/cm$^2$, so that the belt 121 was pressed against the drum 10. Under the above conditions, the illustrative embodiment successfully obviated pretransfer at the downstream side and retransfer at the upstream side and thereby produced desirable images.

Another alternative embodiment of the illustrative embodiment is shown in FIG. 6 and also implemented as a full-color electrophotographic copier. This embodiment is directed mainly toward a low cost construction. Because this embodiment is similar to the embodiment of FIG. 3 except for the following, identical structural elements are designated by identical reference numerals.

As shown in FIG. 6, this embodiment includes an intermediate image transfer unit 220 including an intermediate image transfer belt 221. The belt 221 has an overall volume resistivity of $10^{10}$ Ωcm to $10^{12}$ Ωcm. Specifically, the belt 221 includes an intermediate layer having a medium volume resistivity of $10^{8}$ Ωcm to $10^{11}$ Ωcm, and a surface layer having a surface resistance of $10^{7}$ Ω/cm$^2$ to $10^{14}$ Ω/cm$^2$. With the belt 221 having a medium resistance, it is possible to free the surface of the belt 221 from irregular charging after the primary transfer.

A drive roller 224 included in the intermediate image transfer unit 220 is located downstream of the secondary image transfer region, but upstream of the primary image transfer region, in the direction of movement of the belt 221. A belt cleaning blade 229*a* faces the drive roller 224. In this sense, the drive roller 224 plays the role of the cleaning counter roller 127 of the previous embodiment at the same time. The reference numerals 229*b* and 229*c* designate a brush roller and a lubricant, respectively.

A secondary bias roller 231 and a power supply 802 constitute image transferring means and replace the image transfer unit of the embodiment shown in FIG. 3. The bias roller 231 faces the secondary transfer counter roller 126 of the intermediate image transfer unit 220. This configuration reduces the number of parts necessary for the secondary transfer and thereby reduces the cost, compared to the embodiment shown in FIG. 3.

In the illustrative embodiment, the secondary transfer bias roller 231 and belt 221 directly nip the paper 100 fed to the secondary image transfer position and drive it toward the heat roller 145*a* and press roller 145*b*.

Part of the above construction and operation particular to this embodiment will be described hereinafter. As shown in FIG. 6, a ground roller 223 is so positioned as to contact the belt 221 although the former does not press the latter. This prevents the belt 221 from wrapping around the ground roller 223 and therefore prevents it from curling along the circumference of the ground roller 223 even when left inoperative over a long time. This embodiment not only achieves the same advantages as the embodiment of FIGS. 1 and 2, but also obviates defective images ascribable to the variation of image transfer condition.

A series of experiments were conducted with the above embodiment under the following conditions. The structural members except for ones to be described hereinafter are identical with the structural members of the embodiment of FIG. 3. The belt 221 had an intermediate layer formed of PVDF and titanium oxide and had a volume resistivity of $5\times10^2$ Ωcm when applied with a voltage of 100 V for 10 seconds or a volume resistivity of $2\times10^{11}$ Ωcm when applied with a voltage of 500 V for 10 seconds, as measured at a temperature of 25° C. and a humidity of 45% by Hirester mentioned earlier. The surface layer and base layer of the belt 221 were identical with the surface layer and base layer of the belt 121 of the previous embodiment. The belt 221 was moved at a speed of 156 mm/sec.

Figures 7, 8:
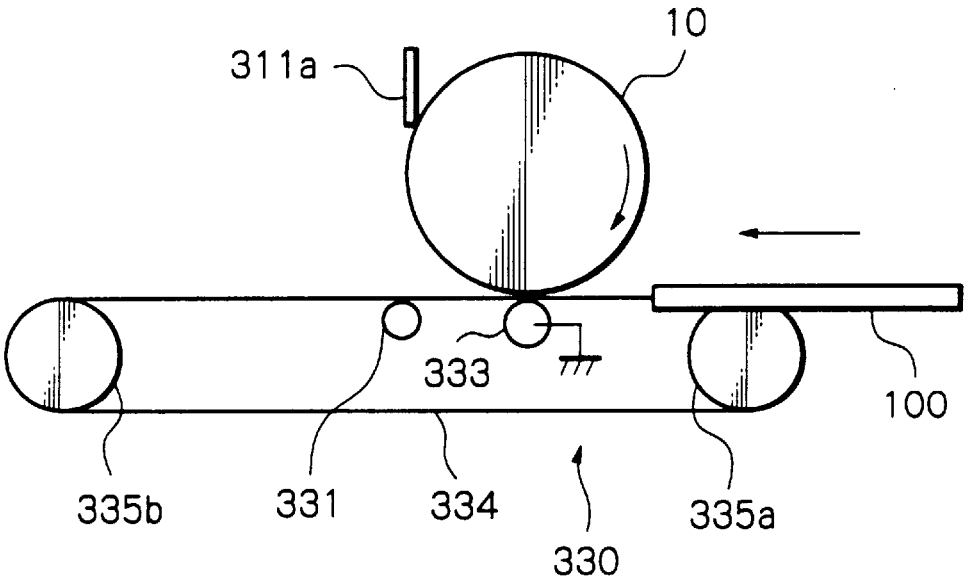
FIG. 7 is a table listing biases selectively applied to a secondary transfer bias roller included in the embodiment of FIG. 6.
FIG. 8 is a view showing a further alternative embodiment of the present invention.

The bias roller 122 was applied with a DC voltage of 1.7 kV for the Bk or first color toner image, a DC voltage of 1.8 kV for the C or second color toner image, a DC voltage of 1.9 kV for the M or third color toner image, and a DC voltage of 2.0 kV for the Y or fourth color toner image. The bias roller 231 for secondary transfer was formed of conductive rubber. As shown in FIG. 7, a particular bias subjected to constant current control was applied to the bias roller 231 for each of different kinds of papers.

As shown in FIG. 6, a primary transfer bias roller 222 was located downstream of the nip between the drum 10 and the belt 121 in the direction of movement of the belt 121. The ground roller 223 was located upstream of the above nip to press the belt 221 toward the drum 10 with a pressure between 0.05 N/cm$^2$ and 2 N/cm$^2$. Under these conditions, the illustrative embodiment successfully obviated pretransfer at the downstream side and retransfer at the upstream side.

A further alternative embodiment of the present invention will be described hereinafter which is applicable to an image forming apparatus of the type including a belt for conveying a paper, OHP sheet or similar recording medium. As shown in FIG. 8, the illustrative embodiment is applied to the drum or image carrier 10 in place of the intermediate image transfer body shown and described. In FIG. 8, the reference numeral 311*a* designates a cleaning blade while the reference numerals 335*a* and 225*b* designate support rollers. In the illustrative embodiment, a toner image is formed on the drum 10 by a conventional electrophotographic process. The toner image is transferred to the paper 100 at the nip between the drum 10 and a belt 334 included in an image transfer unit 330.

Specifically, in the image transfer unit 330, a transfer bias roller or charge depositing means 331 is located downstream of the above nip in the direction of movement of the belt 334. A power supply, not shown, applies a preselected bias for image transfer to the bias roller 331. As a result, an electric field is formed at the nip between the drum 10 and the belt 334, so that a toner image is transferred from the drum 10 to the paper 100 being conveyed by the belt 334. The belt 334 has a medium volume resistance of $10^8$ Ωcm to $10^{11}$ Ωcm.

Part of the above construction unique to the illustrative embodiment is as follows. As shown in FIG. 8, the bias roller 331 is located downstream of the nip, as stated above. A ground roller or discharging means 333 is connected to ground and located upstream of the above nip in such a manner as to press the belt 334 toward the drum 10 with a pressure between 0.05 N/cm$^2$ and 2 N/cm$^2$. In this condition, the ground roller 333 pressed against the belt 334 causes the belt 334 to contact the drum 10 and thereby forms the start point of the nip.

In this embodiment, the ground roller 333 discharges the charge deposited on the belt 334 by the bias roller 331. Therefore, the charge deposited on the belt 334 substantially does not migrate or migrates little to the side upstream of the start point of the nip. That is, the charge does not exist or exists little on the belt 334 upstream of the above nip. It follows that an electric field effecting the toner image transferred to the belt 334 does not exit at the side upstream of the nip. This, coupled with the fact that the belt 334 and drum 10 pressed against each other by the ground roller 333 press the toner entered the nip, causes the toner transferred to the paper 100 to cohere.

As stated above, even when the bias is applied to the bias roller 331 located downstream of the nip in the direct ion of movement of the belt 334, pretransfer does not occur because no electric fields are formed at the upstream side. In addition, the toner image is disturbed little by the downstream electric field because the toner coheres at the nip, obviating retransfer.

All the embodiments shown and described insure attractive images free from toner scattering by obviating pretransfer and retransfer. The characterizing parts of the illustrative embodiments may be replaced with each other.

While each illustrative embodiment has been shown and described as including a ground or discharging means connected to ground, a bias opposite in polarity to the transfer charge may alternatively be applied to the ground roller so long as it does not effect the transfer charge required at the nip.

The bias roller or charge depositing means of any one of the illustrative embodiments may be replaced with any other suitable charge depositing means.

The embodiments described with reference to FIGS. 1–6 each use a secondary transfer bias roller as secondary transfer charge depositing means. The secondary transfer bias roller may, of course, be replaced with a blade, brush or similar secondary transfer charge depositing means. The embodiments described with reference to FIGS. 3 and 6 each are operable even in a copy mode other than the full-color copy mode like the embodiment of FIG. 1.

In all the illustrative embodiments, the photoconductive drum 10 may be replaced with any other suitable image carrier, e.g., a photoconductive belt passed over two or more rollers.

In the embodiments of FIGS. 1–6, the intermediate transfer belt may have any suitable electrical characteristic including a surface resistance, structure and thickness matching with image forming conditions.

In the embodiments shown and described, the drum or image carrier 10 is charged to negative polarity while the developing means effects reversal development by using a two-ingredient type developer, i.e., a toner and carrier mixture. If desired, the drum 10 may be charged to positive polarity, and the developing means may use a single ingredient type developer, i.e., toner or may effect positive development.

In summary, the present invention achieves the following various unprecedented advantages.

(1) A charge deposited on an intermediate image transfer belt is discharged by a discharging member at a nip between an image carrier and the belt. This prevents the influence of an electric field for image transfer from extending to the side upstream of the nip in the direction of movement of the belt and thereby obviates pretransfer, i.e., the transfer of toner from the image carrier to the belt at the upstream side. The discharging member contacts the belt with a pressure between 0.05 $N/cm^2$ and 2 $N/cm^2$, so that the belt and image carrier contact with each other with a pressure high enough to cause the toner to cohere at the nip. As a result, a toner image once transferred from the image carrier to the belt is disturbed little by the above electric field at the side downstream of the nip. This successful ly obviates pretransfer and retransfer causative of toner scattering. Should the above pressure be excessively high, the toner would cohere to an excessive degree and would remain on the image carrier at the time of image transfer, resulting in a vermicular image. The pressure of 2 $N/cm^2$ or below solves such a problem. This advantage is also achievable when the intermediate transfer belt is replaced with a transfer belt or recording medium carrier.

(2) By simply connecting the discharging member to ground, it is possible to reduce a charge deposited on the belt.

(3) The discharging member discharges the belt in the vicinity of the start point of the above nip. Therefore, an image transfer region upstream of the discharging position and contributing to image transfer is broadened, compared to a case wherein the discharging member is located downstream of the start point of the nip. It follows that higher image transfer efficiency is achievable.

(4) Because the belt is not wrapped around the discharging member, the belt is prevented from curling along the circumference of the discharging member even when left unused over a long time. A curled belt would vary the image transfer condition and would thereby bring about a defective image ascribable to, e.g., irregular image transfer.

(5) Moving means is capable of moving the discharging member to a position where the discharging member does not press the belt, but contacts the belt, or a position where it is spaced from the belt. This also achieves the above advantage (4), and in addition reduces damage to the belt and image carrier otherwise pressed against each other. This is also true when the discharging member is replaced with a pressing member.

(6) A roller member, as distinguished from a brush or a blade, reduces damage to the belt even when it exerts a high pressure against the belt. In addition, the roller member does not follow the rotation of the belt when the belt is driven.

(7) Support rollers supporting the belt play the role of a discharging member and a charge depositing member at the same time. This makes it needless to arrange a separate discharging member and a separate charge depositing member and thereby simplifies the construction.

(8) The belt is not wrapped around a pressing member. This is also successful to achieve the above advantage (4).

Various modifications will become possible for those skilled in the art after receiving the teachings of the present disclosure without departing from the scope thereof.

What is claimed is:

1. An image transferring method comprising the steps of:

discharging a charge deposited on an intermediate image transfer belt at a nip located between an image carrier and said intermediate image transfer belt;

moving said intermediate image transfer belt so as to contact a surface of said image carrier over a preselected distance;

depositing a transfer charge on said intermediate image transfer belt at a position downstream of said nip in a direction of movement of said intermediate image transfer belt;

transferring a toner image formed on said image carrier to said intermediate image transfer belt by an electric field formed at said nip; and providing a discharging member, for discharging said charge deposited on said intermediate image transfer belt at said nip so that said discharging member is in contact with a surface of said intermediate image transfer belt opposite to a surface contacting said image carrier with a pressure between 0.05 $N/cm^2$ and 2 $N/cm^2$.

2. An image transferring method comprising the steps of:

discharging a charge deposited on an image transfer belt, said charge being deposited on said image transfer belt at a nip between an image carrier and said image transfer belt, wherein said image transfer belt is moving while contacting a surface of said image carrier over a preselected distance with an intermediary of a recording medium;

depositing a transfer charge on said image transfer belt at a position downstream of said nip in a direction of movement of said image transfer belt; and transferring a toner image formed on said image carrier to said recording medium by an electric field formed at said nip; and using a discharging member to discharge said charge onto said image transfer belt at said nip, said discharging member being in contact with a surface of said image transfer belt opposite to a surface contacting said image carrier with a pressure between 0.05 $N/cm^2$ and 2 $N/cm^2$.

3. An image forming apparatus comprising:

an image carrier; and an intermediate image transfer unit, said intermediate image transfer unit comprising:

an intermediate image transfer belt, said intermediate image transfer belt being movable while contacting a surface of said image carrier over a preselected distance;

a discharging member for discharging a charge deposited on said intermediate image transfer belt at a nip between said intermediate image transfer belt and said image carrier; and a charge depositing member for depositing a transfer charge on said intermediate image transfer belt at a position downstream of said nip in a direction of movement of said intermediate image transfer belt, whereby a toner image formed on said image carrier is transferred to said intermediate image transfer belt by an electric field formed at said nip; and said discharging member discharging said charge deposited on said intermediate image transfer belt at said nip so that said discharging member is in contact with a surface of said intermediate image transfer belt opposite to a surface contacting said image carrier with a pressure between 0.05 $N/cm^2$ and 2 $N/cm^2$.

4. An apparatus as claimed in claim 3, wherein said discharging member is connected to ground.

5. An apparatus as claimed in claim 4, wherein said discharging member adjoins a start point of said nip.

6. An apparatus as claimed in claim 4, wherein a start point of said nip coincides with a position where said discharging member and said intermediate image transfer belt contact each other.

7. An apparatus as claimed in claim 4, wherein said discharging member is located to contact said intermediate image transfer belt without being pressed against said intermediate image transfer belt.

8. An apparatus as claimed in claim 4, wherein said intermediate image transfer unit further comprises moving means for moving said discharging member between a position where said discharging member presses said intermediate image transfer belt into contact with said image carrier and a position where said discharging member contacts said intermediate image transfer belt without being pressed against said intermediate image transfer belt or a position where said discharging member is spaced from said intermediate image transfer belt.

9. An apparatus as claimed in claim 4, wherein said discharging member comprises a roller.

10. An apparatus as claimed in claim 4, wherein said charge depositing member comprises a support roller supporting said intermediate image transfer belt.

11. An apparatus as claimed in claim 3, wherein said discharging member adjoins a start point of said nip.

12. An apparatus as claimed in claim 11, wherein said discharging member is located to contact said intermediate image transfer belt without being pressed said intermediate image transfer belt.

13. An apparatus as claimed in claim 11, wherein said intermediate image transfer unit further comprises moving means for moving said discharging member between a position where said discharging member presses said intermediate image transfer belt into contact with said image carrier and a position where said discharging member contacts said intermediate image transfer belt without being pressed against said intermediate image transfer belt or a position where said discharging member is spaced from said intermediate image transfer belt.

14. An apparatus as claimed in claim 11, wherein said discharging member comprises a roller.

15. An apparatus as claimed in claim 11, wherein said charge depositing member comprises a support roller supporting said intermediate image transfer belt.

16. An apparatus as claimed in claim 3, wherein a start point of said nip coincides with a position where said discharging member and said intermediate image transfer belt contact each other.

17. An apparatus as claimed in claim 16, wherein said discharging member is located to contact said intermediate image transfer belt without being pressed said intermediate image transfer belt.

18. An apparatus as claimed in claim 16, wherein said intermediate image transfer unit further comprises moving means for moving said discharging member between a position where said discharging member presses said intermediate image transfer belt into contact with said image carrier and a position where said discharging member contacts said intermediate image transfer belt without being pressed against said intermediate image transfer belt or a position where said discharging member is spaced from said intermediate image transfer belt.

19. An apparatus as claimed in claim 16, wherein said discharging member comprises a roller.

20. An apparatus as claimed in claim 16, wherein said charge depositing member comprises a support roller supporting said intermediate image transfer belt.

21. An apparatus as claimed in claim 3, wherein said discharging member is located to contact said intermediate image transfer belt without being pressed said intermediate image transfer belt.

22. An apparatus as claimed in claim 21, wherein said discharging member comprises a roller.

23. An apparatus as claimed in claim 21, wherein said charge depositing member comprises a support roller supporting said intermediate image transfer belt.

24. An apparatus as claimed in claim 3, wherein said intermediate image transfer unit further comprises moving means for moving said discharging member between a position where said discharging member presses said intermediate image transfer belt into contact with said image carrier and a position where said discharging member contacts said intermediate image transfer belt without being pressed against said intermediate image transfer belt or a position where said discharging member is spaced from said intermediate image transfer belt.

25. An apparatus as claimed in claim 24, wherein said discharging member comprises a roller.

26. An apparatus as claimed in claim 24, wherein said charge depositing member comprises a support roller supporting said intermediate image transfer belt.

27. An apparatus as claimed in claim 3, wherein said discharging member comprises a roller.

28. An apparatus as claimed in claim 3, wherein said charge depositing member comprises a support roller supporting said intermediate image transfer belt.

29. An image forming apparatus comprising:

an image carrier; and an image transfer unit, said image transfer unit comprising:

an image transfer belt, said image transfer belt being movable while contacting a surface of said image carrier over a preselected distance with an intermediary of a recording medium;

a discharging member for discharging a charge deposited on said image transfer belt at a nip between said image transfer belt and said image carrier;

a charge depositing member for depositing a transfer charge on said image transfer belt at a position downstream of said nip in a direction of movement of said image transfer belt, whereby a toner image formed on said image carrier is transferred to the recording medium by an electric field formed at said nip; and said discharging member discharging said charge deposited on said image transfer belt at said nip so that said discharging member is in contact with said image transfer belt at a surface opposite to a surface contacting said image carrier with a pressure between 0.05 $N/cm^2$ and 2 $N/cm^2$.

30. An apparatus as claimed in claim 29, wherein said discharging member is connected to ground.

31. An apparatus as claimed in claim 30, wherein said discharging member adjoins a start point of said nip.

32. An apparatus as claimed in claim 30, wherein a start point of said nip coincides with a position where said discharging member and said image transfer belt contact each other.

33. An apparatus as claimed in claim 30, wherein said discharging member is located to contact said image transfer belt without being pressed against said image transfer belt.

34. An apparatus as claimed in claim 30, wherein said intermediate image transfer unit further comprises moving means for moving said discharging member between a position where said discharging member presses said image transfer belt into contact with said image carrier and a position where said discharging member contacts said image transfer belt without being pressed against said image transfer belt or a position where said discharging member is spaced from said image transfer belt.

35. An apparatus as claimed in claim 30, wherein said discharging member comprises a roller.

36. An apparatus as claimed in claim 30, wherein said charge depositing member comprises a support roller supporting said image transfer belt.

37. An apparatus as claimed in claim 29, wherein said discharging member adjoins a start point of said nip.

38. An apparatus as claimed in claim 37, wherein said discharging member is located to contact said image transfer belt without being pressed against said image transfer belt.

39. An apparatus as claimed in claim 37, wherein said intermediate image transfer unit further comprises moving means for moving said discharging member between a position where said discharging member presses said image transfer belt into contact with said image carrier and a position where said discharging member contacts said image transfer belt without being pressed against said image transfer belt or a position where said discharging member is spaced from said image transfer belt.

40. An apparatus as claimed in claim 37, wherein said discharging member comprises a roller.

41. An apparatus as claimed in claim 37, wherein said charge depositing member comprises a support roller supporting said image transfer belt.

42. An apparatus as claimed in claim 37, wherein a start point of said nip coincides with a position where said discharging member and said image transfer belt contact each other.

43. An apparatus as claimed in claim 42, wherein said discharging member is located to contact said image transfer belt without being pressed against said image transfer belt.

44. An apparatus as claimed in claim 42, wherein said intermediate image transfer unit further comprises moving means for moving said discharging member between a position where said discharging member presses said image transfer belt into contact with said image carrier and a position where said discharging member contacts said image transfer belt without being pressed against said image transfer belt or a position where said discharging member is spaced from said image transfer belt.

45. An apparatus as claimed in claim 42, wherein said discharging member comprises a roller.

46. An apparatus as claimed in claim 42, wherein said charge depositing member comprises a support roller supporting said image transfer belt.

47. An apparatus as claimed in claim 29, wherein said discharging member is located to contact said image transfer belt without being pressed against said image transfer belt.

48. An apparatus as claimed in claim 47, wherein said discharging member comprises a roller.

49. An apparatus as claimed in claim 47, wherein said charge depositing member comprises a support roller supporting said image transfer belt.

50. An apparatus as claimed in claim 47, wherein said intermediate image transfer unit further comprises moving means for moving said discharging member between a position where said discharging member presses said image transfer belt into contact with said image carrier and a position where said discharging member contacts said image transfer belt without being pressed against said image transfer belt or a position where said discharging member is spaced from said image transfer belt.

51. An apparatus as claimed in claim 47, wherein said discharging member comprises a roller.

52. An apparatus as claimed in claim 29, wherein said discharging member comprises a roller.

53. An apparatus as claimed in claim 29, wherein said charge depositing member comprises a support roller supporting said image transfer belt.

* * * * *